US006139352A

United States Patent [19]

Daoud

[11] Patent Number: 6,139,352

[45] Date of Patent: Oct. 31, 2000

[54] INSULATION DISPLACEMENT CONNECTOR WITH SELECTIVELY REMOVABLE ABUTMENT WALL

[75] Inventor: Bassel H. Daoud, Parsippany, N.J.

[73] Assignee: Lucent Technologies Inc., Murray Hill, N.J.

[21] Appl. No.: 09/218,068

[22] Filed: Dec. 21, 1998

[51] Int. Cl.[7] ..... H01R 4/24

[52] U.S. Cl. ..... 439/404; 439/409; 439/948; 439/417

[58] Field of Search ..... 439/409, 417, 439/948, 922, 404, 397, 623, 502, 710, 711, 712, 718, 709

[56] References Cited

U.S. PATENT DOCUMENTS

| | | | |
|---|---|---|---|
| 3,611,264 | 10/1971 | Ellis | 439/403 |
| 3,890,029 | 6/1975 | Izraeli | 439/397 |
| 4,662,699 | 5/1987 | Vachhani et al. | 439/395 |
| 4,793,823 | 12/1988 | Cozzens et al. | 439/409 |
| 5,224,881 | 7/1993 | Lejuste et al. | 439/922 |
| 5,240,432 | 8/1993 | Daoud | 439/417 |
| 5,451,170 | 9/1995 | Sulfi | 439/922 |
| 5,484,304 | 1/1996 | Capper et al. | 439/409 |
| 5,637,011 | 6/1997 | Meyerhoefer et al. | 439/409 |
| 5,860,829 | 1/1999 | Hower et al. | 439/417 |

OTHER PUBLICATIONS

Technical Data Sheet of A.C. Egerton Limited, related to Mini Rocker Cross Connection Cabinets.

*Primary Examiner*—Paula Bradley
*Assistant Examiner*—Tho D. Ta
*Attorney, Agent, or Firm*—Stroock & Stroock & Lavan LLP

[57] ABSTRACT

An insulation displacement connector having an abutment wall for selectively permitting passage of a wire through a wire passageway and out of the connector. A wire is inserted into an insertion hole of the wire passageway and is prevented from passing beyond the abutment wall. Yet, upon removal of the abutment wall an exit aperture is created which permits passage of the wire out of the connector.

31 Claims, 4 Drawing Sheets

INSULATION DISPLACEMENT CONNECTOR WITH SELECTIVELY REMOVABLE ABUTMENT WALL

FIELD OF THE INVENTION

This invention relates to an insulation displacement connector and, in particular, to a wire capture device for selectively routing a wire exiting the first connector beyond the connector for facilitating further connections.

BACKGROUND OF THE INVENTION

Telephone lines, which are carried by electrical conductors known as tip ring wire pairs, are generally aggregated at a particular point in a building prior to being distributed and connected to various types of telephone equipment, such as, for example, telephones, fax machines, modems etc. As the tip ring pairs generally enter the building as part of a multi-conductor cable, the individual tip ring wire pairs must first be broken out from the cable into individual wire pairs. This is normally accomplished in a junction box known as, for example, a building entrance protector (BEP), or network interface unit (NIU). Within such devices the individual telephone line tip ring pairs are separated from the table, individually connected to a connector block, and made available for further electrical connection and distribution. Usually there is a protector device inserted between the telephone and central office, or network side of the telephone line and the customer equipment or terminal side of the telephone line to protect the telephone and user, or other equipment connected to the telephone line, from hazardous overvoltages induced in the telephone network or in the cables passing between the telephone central office and the building within which the line is terminated.

In a typical arrangement, the telephone lines coming from the network are first wired to a protector field, which is an array of connectors for receiving the protector device, which is in turn hard wired to a first connector block which provides a first test point for testing the telephone line connections between the building and telephone central office. This first terminal block is hard wired to a multi pair connector, most typically a twenty-five pair connector of the RJ21 type, for further connection to an array of customer bridges which are also hard wired and connectorized via a mating RJ21 connector. The use of a customer bridge permits a subscriber to disconnect terminal equipment from a telephone line so that subscriber can isolate troubles on the line as originating in the telephone network, or on the terminal equipment side of the telephone line. An example of such an arrangement is shown in U.S. Pat. No. 5,363,440, dated Nov. 8, 1994, the disclosure of which is incorporated herein by reference. U.S. Pat. No. 5,363,440, depicts a multi-layered network interface unit which results in size economies due to the fact that the customer bridge connector block is hingeably connected to the telephone network protector array field so that rather than placing these two arrays side by side they can be mounted in overlying relationship, resulting in a saving of space.

Additionally, there are known dual sided insulation displacement connector (IDC) blocks for use in such junction boxes and/or distribution fields. These known terminal blocks consist of an IDC type connector on one side of the connector block, and a matching, electrically connected IDC type connector on the other side of the block, and are known as mini-rocker type connectors, such as those sold by A. C. Egerton, LTD.

In some instances it is desirable to have exit apertures or feed through holes to pass a tip ring pair of wires to multiple different connectors. This would have the advantage of enabling customers to branch wires between terminals. However, permanent feed through holes are disadvantageous in two ways. First, the wire retention regions of IDC type connectors are optionally filled with a gel to ensure proper electrical connections and to prevent rusting of terminal points. Since the gel lacks viscosity when first injected into the wire passages and would easily flow out of the feed through hole, connectors having permanent feed through holes cannot be readily gel filled. Second, in certain applications, customers may not wish to branch wires between terminals. In such applications, the customer must trim the wires flush with the connector surface so that it does not protrude past the feed through hole. The trimmed wires may then land between terminals causing electrical shorts. In addition, the wire trimming procedure results in additional labor, time, and thus additional cost.

Although present connectors without feed through holes eliminate the aforementioned problems with permanent feed through holes, such connectors are disadvantageous because they offer the customer no flexibility to branch wires between terminals.

SUMMARY OF THE INVENTION

The present invention is directed at overcoming shortcomings in the prior art. The invention comprises an insulation displacement connector (IDC) having an abutment wall configured for providing the optional pass through of a wire inserted through a wire passageway of a connector to a point beyond the connector, or, if there is no need to pass a wire through the connector, to prevent the wire from extending beyond the connector thereby eliminating trimming.

The abutment wall of the present invention is located at the end of an extension having a thin wall. The extension is removably mounted or frangibly connected to the rear end of the wire passageway of the IDC, thereby preventing passage of a wire out of the connector.

The abutment wall prevents the wire from interfering with other connectors and eliminating the need for trimming. Furthermore, connectors are preferably filled with gel, which consists of a base and a hardener, and is applied to prevent moisture and air from forming rust on the terminal strips. Rust causes intermittent telephone line connections and may lead to eventual telephone equipment failure. Because the passageway is closed at one end, gel will not flow out of the hole and will be permitted time to cure. Should a customer wish to branch wire between terminals, the customer can optionally trim off the abutment wall, thus creating an exit aperture. Since this may be done after the gel has cured, the gel will not flow out of the hole.

Other objects and features of the present invention will become apparent from the following detailed description, considered in conjunction with the accompanying drawing figures. It is to be understood, however, that the drawings, which are not to scale, are designed solely for the purpose of illustration and not as a definition of the limits of the invention, for which reference should be made to the appended claims.

BRIEF DESCRIPTION OF THE DRAWINGS

In the drawing figures, which are not to scale, and which are merely illustrative, and wherein like reference numerals depict like elements throughout the several views.

DETAILED DESCRIPTION OF THE PREFERRED EMBODIMENTS

Figure 1:
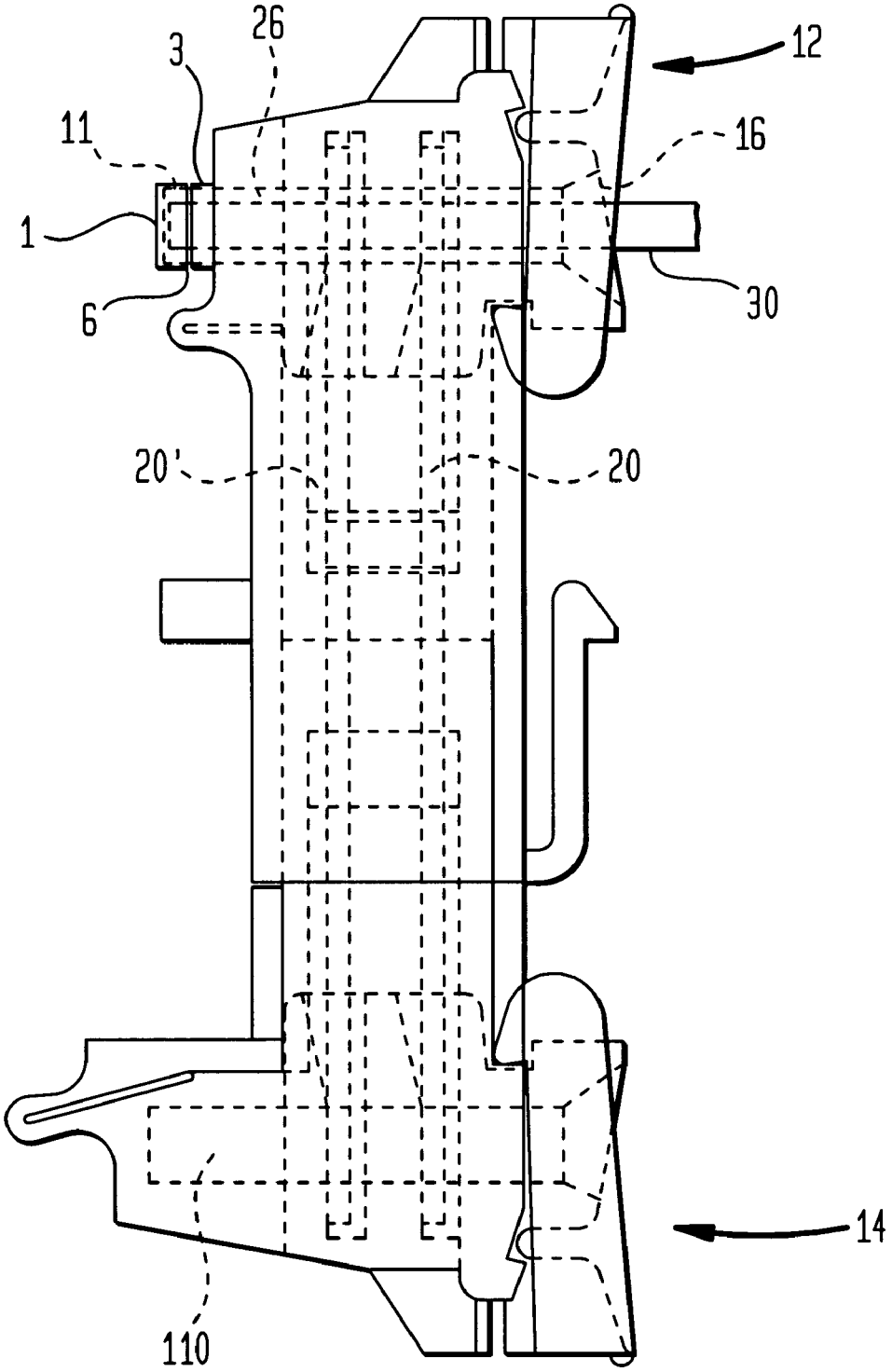
FIG. 1 is a side view of a dual-sided tool-less insulation displacement connector in accordance with the present invention.
Figure 2:
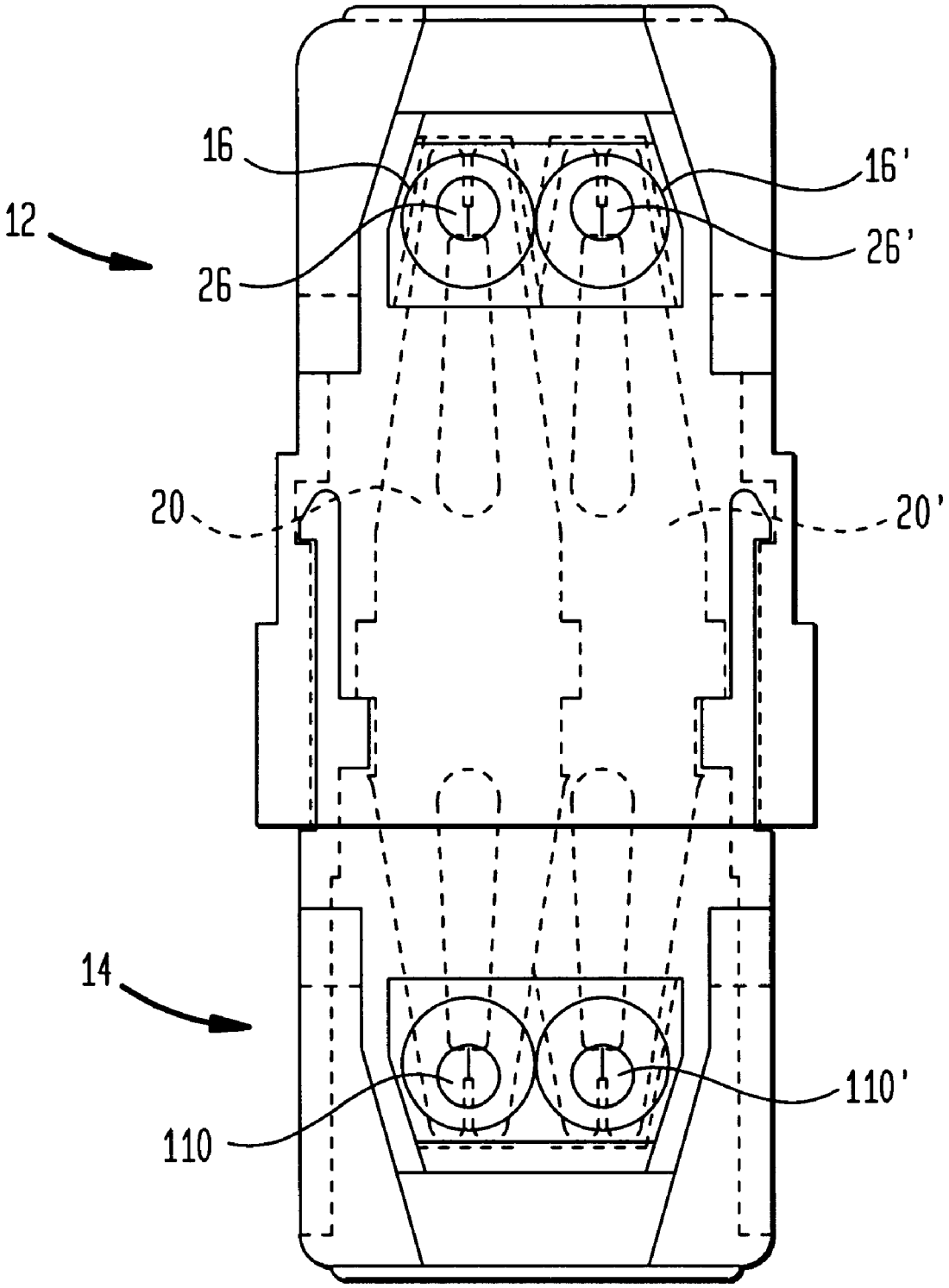
FIG. 2 is a front view of the connector of FIG. 1.
Figure 3:
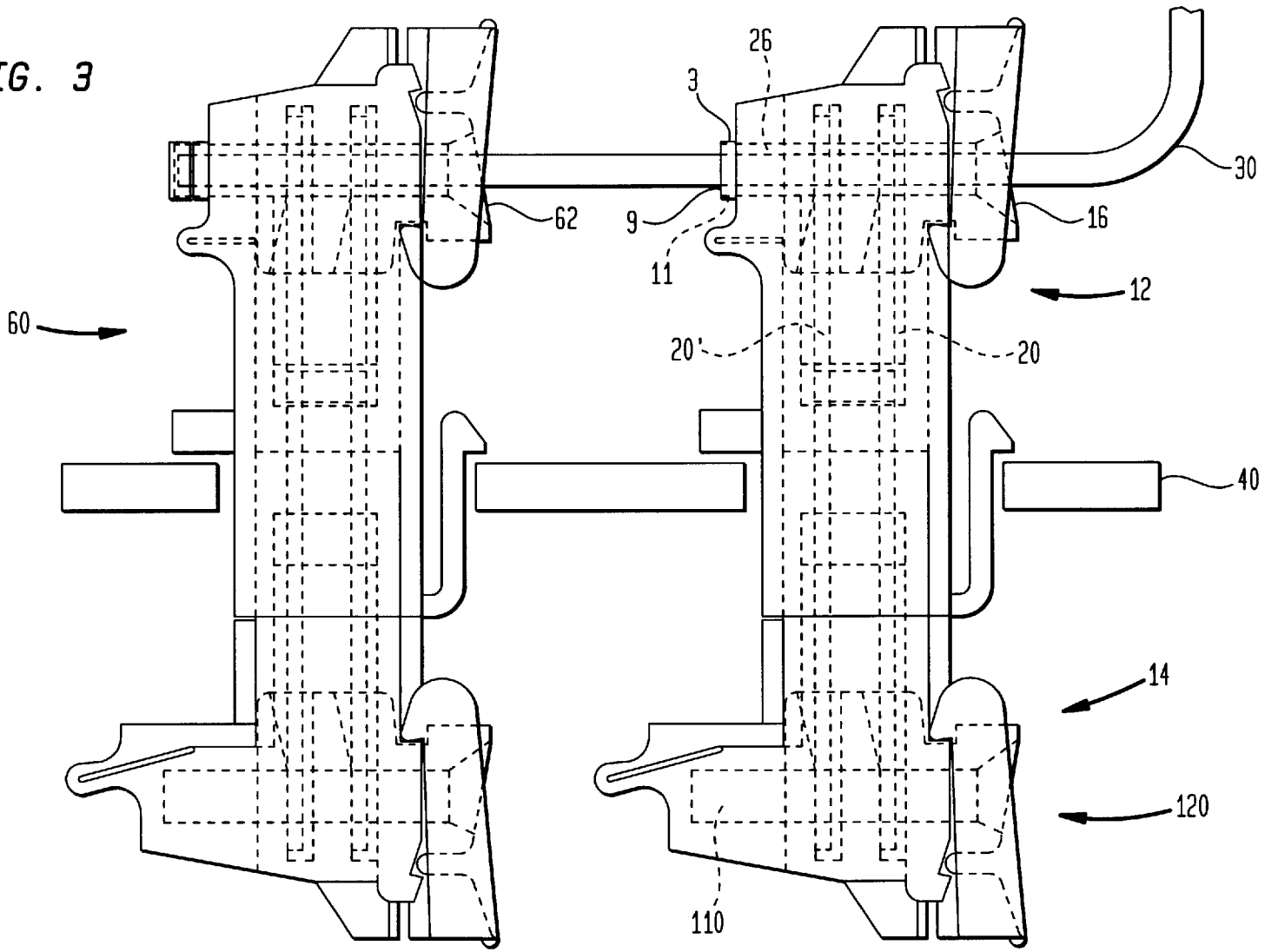
FIG. 3 is a side view of an exemplary pair of connectors of FIG. 1 as part of a double sided an array mounted on a double sided surface.

With reference to FIGS. 1 through 3, there is shown an insulation displacement connector 12 having a selectably removable abutment wall 1 constructed in accordance with the present invention. The selectably removable abutment wall of the present invention, generally indicated at 1, is located at the end of an extension 3 having a thin wall 11. Thin wall 11 may be provided with a groove 6, discussed further below.

Referring to FIGS. 1 and 2, connector 12 includes a pair of wire insertion holes 16, 16' in fluid communication with a pair of wire passageways 26, 26'. In a preferred embodiment, connector 12 is a tool-less IDC of the mini-rocker type. Connector 12 may be electrically connected to a second connector 14, by way of non-limiting example, of the mini-rocker tool-less IDC type. However, one skilled in the art will recognize that connector 14 may be any type of connector known in the art utilizing wire passageways of the same or similar type to those shown and described herein. The choice of connector is application specific.

With reference to FIGS. 1 and 3, connector 12, in accordance with the present invention, includes a selectively removable abutment wall 1 for creating a wire exit aperture 9. In contrast, connector 14 depicts a connector having a permanently closed wire passageway 110. Unlike connector 14, connector 12 has the advantage of allowing a user the ability to selectively pass a wire beyond the connector.

Referring again to FIG. 1, abutment wall 1 includes extension 3 and is preferably frangibly connected to connector 12. Abutment wall 1 is positioned so that it forms a termination of one end of wire passageway 26. Although connector 12 includes a pair of wire passageways 26, 26' and a pair of abutment walls 1, 1', for the purposes of this description only one wire passageway and abutment wall is referred to.

A wire 30, for example, may be inserted into wire insertion aperture 16 and urged through wire passageway 26, causing wire 30 to pass directly above terminal strip 20 disposed in connector 12. Wire 30 may be passed through wire passageway 26 until it contacts abutment wall 1, at which point the further passage of wire 30 is limited and wire 30 stays contained within connector 12. Because wire 30 passes no further than the interior of connector 12 when limited by abutment wall 1, wire 30 is prevented from interfering with other connectors or terminals, for example, on a connector array 120. Abutment wall 1 also eliminates the need for trimming which may cause trimmed wire pieces to fall in between terminals causing shorts or other malfunctions. As used herein the term wire means any elongated conductor, insulated or non-insulated, commonly encountered in the telephony, electrical and/or electronic arts.

Additionally, while only a pair of connectors are depicted and described, it is intended that the invention herein be applicable to multiple connectors arranged in arrays on connector blocks in a manner known in the art, it being understood that the invention herein may be applied to any one IDC connector, group of IDC connectors, or all IDC connectors on a connector block, as a matter of application specific design choice.

Referring again to FIG. 1, in a preferred embodiment, abutment wall 1 includes extension 3 for displacing abutment wall 1 from the body of connector 12. Extension 3 is preferably of sufficient length to allow a tool (not shown) to be used to trim off abutment wall 1, thereby permitting passage of wire 30 out of connector 12. Extension 3 is provided with a thin wall 11, which is preferably sufficiently thin to prevent the material of extension 3 from stretching or otherwise deforming during the trimming operation, it being preferred that abutment wall 1 snap off or be trimmed cleanly off connector 12.

In a preferred embodiment, as seen in FIG. 1, thin wall 11 of extension 3 may be provided with groove 6. Groove 6 is a portion of extension 3 having a decreased relative thickness as compared to thin wall 11. In the embodiment shown in FIG. 1, groove 6 wraps around the entire circumference of extension 3. However, one skilled in the art will recognize that groove 6 need not wrap around the entire circumference of extension 3. Although groove 6 may be positioned at any point on extension 3, it is preferably positioned so that a tool may be easily wrapped around groove 6 to perform the trimming operation. However, those skilled in the art should recognize that groove 6 may consist of any frangible connection that is readily broken, with or without a tool.

Furthermore, in an alternate embodiment, abutment wall 1 may be removably or fixedly attached to connector 12 via numerous ways known in the art, such as by way of non-limiting example, adhesives such as glues and epoxies, by screwing, snap fitting, or the like. Or, abutment wall 1 may be integrally formed as part of connector 12, as seen in FIG. 1, by way of injection molding.

With reference to FIG. 3, dual sided connector 12 may be mounted on double sided surface 40 of a junction box (not shown). Preferably, dual sided connector 12 is in an array of other such connectors. FIG. 3 depicts a preferred embodiment, by way of non-limiting example, wherein connectors 12 electrically connected to connector 14 are mounted on double sided surface 40 in an array 120. Of course, one skilled in the art knows that any number of connectors may be so arranged, that such arrangement is application specific, and that FIG. 3 is presented for illustrative purposes only. It may be preferable to branch a tip ring pair of wires from one connector 12 to another such connector 60, or any number of other connectors.

To accomplish this branching, abutment wall 1 may be trimmed or removed. Removal of abutment wall 1 creates a wire exit aperture 9 which permits wire 30 to be passed out of connector 12 and passed into connector 60, or any other number of connectors as the particular application demands. As seen in FIG. 3, wire 30 may be urged or pulled through wire exit aperture 9 and inserted into the wire insertion aperture 62 of connector 60 creating an electrical connection between the two connectors.

Abutment wall 1 may be selectively removed via numerous ways known in the art. By way of non-limiting example, a cutting tool may be placed around groove 6 and used to snip off abutment wall 1. Because, in a preferred embodiment, groove 6 is a frangible connection having a thin wall, a grasping tool, for example, may be used to twist off abutment wall 1. In yet other applications, the frangible connection of groove 6 may be simply snapped or twisted off by hand. The above-mentioned means of removing cap 50 are merely illustrative and are not intended to be limiting.

Figure 4:
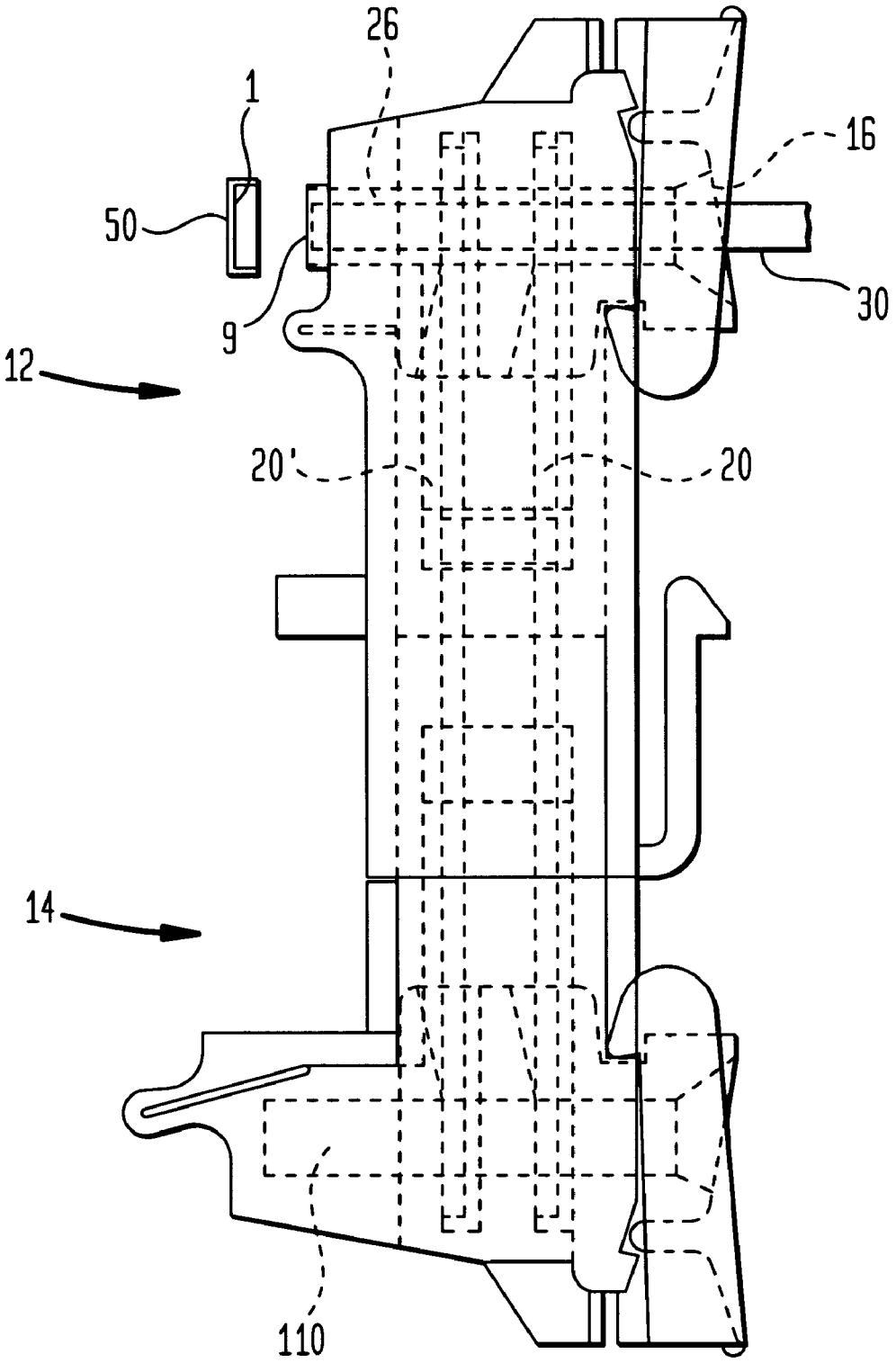
FIG. 4 is a side view of the connector of FIG. 1 wherein the abutment wall of the present invention has been selectively removed.

Referring now to FIG. 4, there is shown a second embodiment of the invention in which abutment wall 1 consists of a removable, replaceable cap 50. Cap 50 is connected to connector 12 over wire passageway 26 so as to prevent passage of wire 30 out of connector 12. Cap 50 may be fitted to connector 12 by any means known in the art, such as, for example, by snap fitting, adhesives, friction fit, screwing, and the like. This embodiment has the added advantage of cap 50 being replaceable should the user select to re-seal wire exit aperture 9 created by removal of cap 50.

The operation of removing replaceable cap 50 is application specific and depends upon the means used to fit cap 50 to connector 12. For example, in an application in which cap 50 is snap fit to connector 12, a grasping tool may be used to grasp and un-snap cap 50 from connector 12. In an alternate application, a tool may be used to unscrew cap 50 from connector 12. The above-mentioned means of removing cap 50 are merely illustrative and are not intended to be limiting.

Abutment wall 1 of the present invention has the added advantage of permitting wire passageway 26 of connector 12 to be filled with a gel (not shown) if it desired to do so. Because the gel is not very viscous when it is injected into wire passageway 26, the gel injected into connectors having permanent feed through holes is liable to flow out of the holes before the gel could cure. However, abutment wall 1, in accordance with the present invention, prevents the gel from flowing out of wire passageway 26 of connector 12. Once the gel cures, it becomes an elastic semi-solid mass or at least viscous enough so that it will not flow out of wire passageway 26. After wiring, exit aperture 9 may be created by the trimming operation or cap removal operation described above.

Thus, while there have been shown and described and pointed out fundamental novel features of the invention as applied to preferred embodiments thereof, it will be understood that various omissions and substitutions and changes in the form and details of the disclosed invention may be made by those skilled in the art without departing from the spirit of the invention. It is the intention, therefore, to be limited only as indicated by the scope of the claims appended hereto.

What is claimed is:

1. An insulation displacement connector, comprising:

a wire insertion aperture in fluid communication with a wire passageway, said wire passageway permitting the passage therein of a wire conductor;

an extension portion extending from said wire passageway; and an abutment wall located at an end of said extension portion furthest from said wire passageway, said abutment wall being frangibly connected to said wire passageway via said extension portion such that upon selective removal of said abutment wall a wire exit aperture is created.

2. The connector of claim 1, wherein said abutment wall is constructed from a non-conducting plastic material.

3. The connector of claim 1, wherein said extension portion has a thin wall.

4. The connector of claim 3, wherein said thin wall further comprises a groove portion having a decreased thickness around the entire circumference of said extension.

5. The connector of claim 1, wherein said abutment wall is integrally formed with said connector as a single molded unit.

6. The connector of claim 5, wherein said molded unit is formed by injection molding.

7. The connector of claim 1, wherein said insulation displacement connector is tool-less.

8. The connector of claim 7, wherein said tool-less insulation displacement connector is dual sided.

9. The connector of claim 1, wherein said connector is part of an array of connectors.

10. The connector of claim 9, wherein said array of connectors is disposed in a junction box.

11. The connector of claim 10, wherein said junction box is a Network Interface Unit.

12. The connector of claim 10, wherein said junction box is a Building Entrance Protector.

13. An insulation displacement connector, comprising:

a wire receiving portion having at least one wire insertion aperture in fluid communication with a wire passageway, said wire passageway permitting the passage therein of a wire conductor;

a terminal housing portion having therein at least one terminal strip, said terminal housing portion hingedly connected to said wire receiving portion, said wire insertable into said wire passageway when said wire receiving portion is in an open position and said wire mechanically engaged by said terminal strip when said wire receiving portion is in a closed position; and an abutment wall located at an end of said wire passageway, said abutment wall being selectively removable from and selectively reattachable to said wire passageway such that upon selective removal of said abutment wall a wire exit aperture is created for permitting the passage of said wire out of said passageway and upon selective reattachment said abutment wall limits the passage of said wire.

14. The connector of claim 13, wherein said abutment wall further comprises a replaceable cap and wherein said wire passageway further comprises an extension.

15. The connector of claim 14, wherein said replaceable cap further comprises a snap fit section and said extension further comprises a snap fit section, such that said cap can be snapped on or off of said extension.

16. The connector of claim 14, wherein said replaceable cap further comprises a thread portion and wherein said extension further comprises a thread portion, such that said cap can be screwed on or off of said extension.

17. The connector of claim 14, wherein said replaceable cap has a diameter slightly larger than a diameter of said extension, such that said cap can slide on or off of said extension.

18. The connector of claim 13, wherein said insulation displacement connector is tool-less.

19. The connector of claim 18, wherein said tool-less insulation displacement connector is dual sided.

20. The connector of claim 13, wherein said connector is part of an array of connectors.

21. The connector of claim 20, wherein said array of connectors is disposed in a junction box.

22. The connector of claim 21, wherein said junction box is a Network Interface Unit.

23. The connector of claim 21, wherein said junction box is a Building Entrance Protector.

24. An insulation displacement connector, comprising:

a wire insertion aperture in fluid communication with a wire passageway, said wire passageway permitting the passage therein of a wire conductor; and an extension portion extending from said wire passageway and having a grooved section of decreased thickness formed around the entire circumference of said extension portion; and an abutment wall located at an end of said extension portion furthest from said wire passageway, said abutment wall removably mounted to said extension portion at said grooved section.

25. The connector of claim 24, wherein said insulation displacement connector is tool-less.

26. The connector of claim 25, wherein said tool-less insulation displacement connector is dual sided.

27. The connector of claim 24, wherein said connector is part of an array of connectors.

28. The connector of claim 27, wherein said array of connectors is disposed of in a junction box.

29. The connector of claim 28, wherein said junction box is a Network Interface Unit.

30. The connector of claim 28, wherein said junction box is a Building Entrance Protector.

31. An insulation displacement connector, comprising:

a wire insertion aperture in fluid communication with a wire passageway, said wire passageway permitting the passage therein of a wire conductor;

an extension portion extending from said wire passageway, said extension portion having a groove of decreased thickness; and an abutment wall located at an end of said extension portion furthest from said wire passageway, said abutment wall frangibly connected to said wire passageway via said groove such that upon selective removal of said abutment wall a wire exit aperture is created.

* * * * *